US010767394B2

(12) United States Patent
Nußbaum et al.

(10) Patent No.: US 10,767,394 B2
(45) Date of Patent: Sep. 8, 2020

(54) LOCKABLE COUPLING DEVICE

(71) Applicant: Solarlux GmbH, Melle (DE)

(72) Inventors: Björn Nußbaum, Osnabrück (DE); Uwe Niehausmeier, Rödinghausen (DE)

(73) Assignee: Solarlux GmbH, Melle (DE)

( * ) Notice: Subject to any disclaimer, the term of this patent is extended or adjusted under 35 U.S.C. 154(b) by 371 days.

(21) Appl. No.: 15/871,483

(22) Filed: Jan. 15, 2018

(65) Prior Publication Data

US 2018/0202197 A1 Jul. 19, 2018

(30) Foreign Application Priority Data

Jan. 16, 2017 (DE) ..... 10 2017 100 742

(51) Int. Cl.

| | |
|---|---|
| ***E05B 65/00*** | (2006.01) |
| ***E06B 3/48*** | (2006.01) |
| ***E06B 3/263*** | (2006.01) |
| ***E05B 65/08*** | (2006.01) |
| ***E05F 3/22*** | (2006.01) |

(52) U.S. Cl.

CPC ..... *E05B 65/0085* (2013.01); *E05B 65/08* (2013.01); *E05F 3/22* (2013.01); *E06B 3/26303* (2013.01); *E06B 3/481* (2013.01); *E05B 2065/0805* (2013.01); *E05F 2003/228* (2013.01); *E05F 2700/02* (2013.01); *E05Y 2900/55* (2013.01); *E06B 2003/26389* (2013.01)

(58) Field of Classification Search

CPC ..... E05B 65/0085; E05B 65/08; E05B 2065/0805; E06B 3/26303; E06B 3/481; E06B 2003/26389; E05F 3/22; E05F 2700/02; E05F 2003/228; E05Y 2900/55

USPC ..... 70/118; 160/201

See application file for complete search history.

(56) References Cited

U.S. PATENT DOCUMENTS

| | | | | |
|---|---|---|---|---|
| 2014/0047770 | A1* | 2/2014 | Vaknin | E05C 19/00 49/349 |
| 2014/0224435 | A1* | 8/2014 | Stawski | E05D 15/0621 160/188 |
| 2018/0223573 | A1* | 8/2018 | Wolfe | E06B 3/4636 |

FOREIGN PATENT DOCUMENTS

| | | |
|---|---|---|
| DE | 198 09 601 | 9/1999 |
| EP | 0 342 420 | 11/1989 |
| JP | S5799068 | 6/1982 |

* cited by examiner

*Primary Examiner* — Daniel P Cahn
(74) *Attorney, Agent, or Firm* — Gudrun E. Huckett

(57) ABSTRACT

A coupling device for coupling folding elements of a folding device has first and second coupling elements that lock the folding elements relative to each other. The coupling device has a locking device with sliding element whose rearward part, when the second folding element is not closed, is in a rest position in which a locking member of the sliding element engages a locking receptacle of the first coupling element when the coupling elements are latched. In the rest position, the locking member contacts a guiding contour of the second coupling element and unlocking of the locking member from the locking receptacle by pulling on the coupling elements is prevented. When the second folding element is closed, the rearward part of the sliding element contacts the frame causing the locking member to move along the guiding contour out of the locking receptacle; the locking action is released.

14 Claims, 6 Drawing Sheets

Fig. 6b
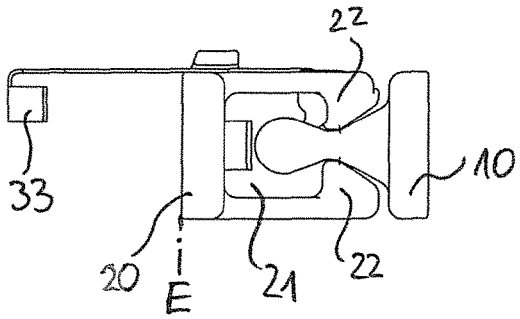
Fig. 7b
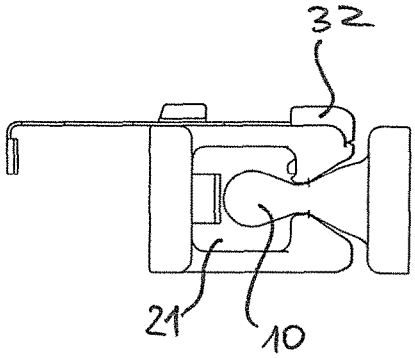
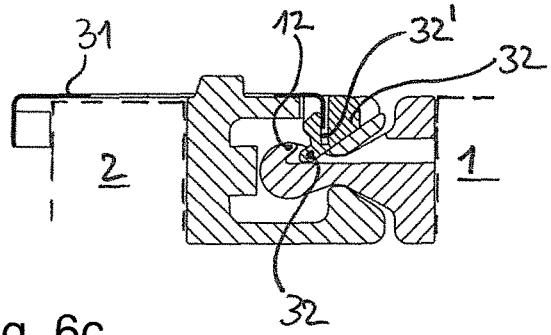
Fig. 6c
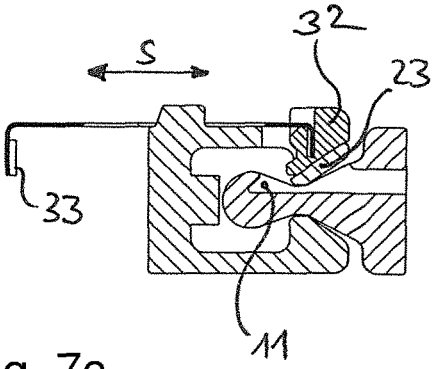
Fig. 7c
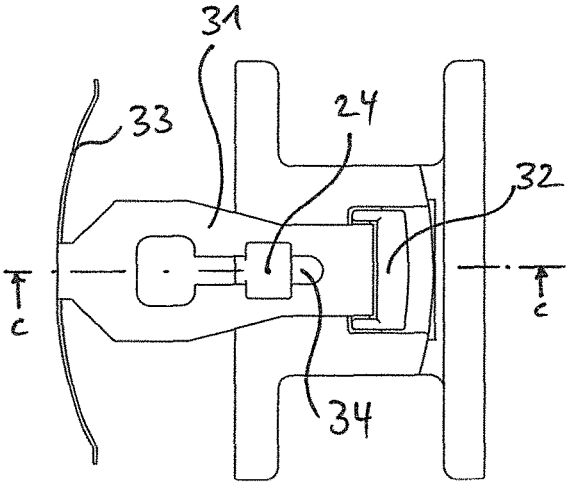
Fig. 6a
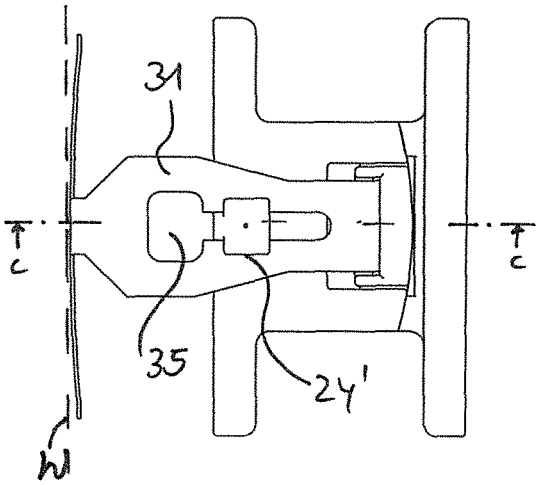
Fig. 7a

LOCKABLE COUPLING DEVICE

BACKGROUND OF THE INVENTION

The invention relates to a lockable coupling device in particular for folding devices.

In folding devices with three or a greater number of folding elements arranged within a frame, one folding element that is opened first when opening the folding device is arranged pivotably on the neighboring folding element. When the first folding element is opened, for example, by approximately 90° and subsequently the neighboring second folding element is also opened, an increased load caused by the weight and leverage of the first folding element is acting on the second folding element. This can cause undesirable deformations of the second folding element which may lead to false positioning of both folding elements and also of further folding elements relative to the frame and, for example, can cause functional restrictions or loss of comfort in operating the folding device, for example, due to contacting and dragging of the bottom side of the folding elements on the floor when opening the folding elements.

It is therefore preferred that, prior to opening the second folding element, the first folding element is placed against the second folding element (opening angle of the first element of approximately 180°) and is secured in this position. This connection should be existing until the second folding element has reached the closed position again.

A coupling device that ensures this is disclosed in EP 0 342 420 B2. In this reference, a three-panel folding wall together with locking system with strictly prescribed locking sequence is described. Here, a first folding element can be pivoted against a second folding element by approximately 180° and can be fixed in this position. A mechanism prevents that the first folding element detaches from the second folding element when the second folding element is not in the closed position. Moreover, a second mechanism effects that the second folding element can be opened only once the first folding element has been secured at the second folding element. Observing this locking sequence is ensured by two different devices, and each device comprises a great number of components. This is disadvantageous in regard to production, assembly, and servicing of the device.

In practice, a lockable coupling devices is also known which comprises a latch whose two parts are attached to the folding elements that are to be fixed in position. In the female part of the latch, a hook that is loaded by a spring force and is rotatably supported is installed which locks the connection of the latch parts when they latch relative to each other. The hook comprises an angled lever extension which is projecting out of the female part of the latch. This projecting part acts as a sensing device that projects rearwardly past a horizontal or vertical boundary part of the second folding element. In a closed position of the second folding element, either a neighboring third folding element or the frame is pushing against the sensing device and unlocks the latching connection. A disadvantage of this device is that the sensing device can also be triggered by hand. Also, an exchange of individual parts is relatively complicated so that in case of defects usually the entire device must be exchanged.

The invention has the object to avoid the aforementioned disadvantages of the prior art and to provide a coupling device for a folding device with at least three folding elements that is as simple as possible and lockable, wherein the coupling device locks a releasably lockable coupling between a first folding element and a second folding element when the second folding element is not in the closed position and unlocks it when the second folding element is in the closed position.

SUMMARY OF THE INVENTION

In accordance with the present invention, this is achieved by a coupling device for a folding device, in particular a glass folding device, with at least three folding elements that are arranged in particular in a frame and that each comprise two horizontal and two vertical boundary parts and are substantially planar, wherein the coupling device comprises two coupling elements that are releasably lockable with each other and are embodied as locking element and locking receptacle, wherein a first coupling element is arranged at a first folding element of the folding device and a second coupling element is arranged at a second folding element of the folding device neighboring the first folding element, wherein the first folding element is arranged pivotably about a substantially vertical axis at the second folding element in such a way that the first folding element can be pivoted toward the second folding element such that the coupling elements reach a latched position. The coupling device further comprises a locking device with a sliding element, wherein the sliding element is slidably arranged on the second coupling element substantially perpendicular to the plane of the second folding element and projects with a leading part past a leading edge of the horizontal boundary part of the second folding element that is facing the second coupling element, wherein a locking member is arranged on the leading part. The sliding element further projects with a rearward part past a rear edge of the horizontal boundary part of the second folding element that is facing away from the second coupling element, wherein the rearward part of the sliding element is supported elastically (spring action) on the side of the second folding element which is opposite the second coupling element in such a way that the rearward part, when the second folding element is not in the closed position, is located in a rest position in which the rearward part is projecting past the rearward edge. In the rest position, the locking member arranged at the leading part of the sliding element, when the two coupling elements are latched, engages lockingly a locking receptacle embodied in the first coupling element. In the rest position, the locking member is contacting a guiding contour provided at the second coupling element in such a way that unlocking of the locking member by a pulling action acting between the first and the second coupling elements is prevented. Upon closing of the second folding element, the rearward part of the sliding element is in operative contact with the frame that is acting as an abutment so that the locking member is pushed along the guiding contour out of the locking receptacle and releases the locking action of the locking device.

Thus, a first coupling element that is arranged at the first folding element and a second coupling element that is arranged at the second folding element provide a releasably lockable coupling. The coupling elements can be embodied so as to be complementary to each other as a male latching part and a female latching receptacle. Preferably, the first coupling element is a male latching part and the second coupling element is a female latching receptacle. Preferably, the coupling elements are screwed to the respective folding elements or are locked by a snap-on action to the frame sections of the folding elements.

In addition, the coupling device comprises a locking device that automatically locks the coupling elements when they are latched to each other when the second folding element is not in the closed position (i.e., the rest position of the second folding element) and, on the other hand, cancels this locking action as soon as the second folding element reaches the closed position. This preferably monolithically formed locking device is associated with the second coupling element and a horizontal boundary part (usually the frame section) of the second folding element. The locking device projects in this context past a leading edge of the upper boundary part of the second folding element which is facing the second coupling element and also projects past a rearward edge of the upper boundary part of the second folding element which is facing away from the second coupling element.

The rearward part of the locking device forms a sensing device which is elastically supported on the side of the folding element which is facing away from the second coupling element; the abutment of the sensing device is the frame in which the folding elements are mounted. Preferably, a region of the rearward part of the locking device is embodied as a leaf spring. In a substantially unclosed position of the second folding device, the springy part of the locking device is in the unstressed state (rest position), wherein the rearward part of the locking device projects past the rearward edge.

The locking device is supported slidably on the second coupling element in a direction that is substantially perpendicular to the plane of the folding element. Preferably, this is achieved by a projection which is formed on the second coupling element and a slot which is complementarily embodied in the locking device. The projection has preferably moreover a widened portion which is projecting past the slot and substantially blocks a movement of the locking device in vertical direction. For simplifying the assembly, the guide slot has a mounting opening that is wider than the widened portion of the projection. The mounting opening is furthermore preferably not arranged in an area of the guide slot which in the finish-mounted operating state of the locking device is in operative connection with the projection.

The leading part of the locking device comprises a region which in the unstressed rest position of the locking device lockingly engages the first coupling element upon latching of the two coupling elements. Preferably, the first coupling element in this context has a locking receptacle (recess) in the locking member that can be engaged by the leading part of the locking device. When a force is applied for opening the coupling, even though the second folding element is not closed, for example, by pulling the first folding element and thus the first coupling element in a direction opposite to the second coupling element, a guiding contour which is formed in the second coupling element and is in contact with the leading part of the locking device blocks a movement of the locking device. This is preferably achieved in that the leading part of the locking device engages the recess and acts like a barb to block the guiding contour against removal of the barb in case of the described pulling action. The locking engagement of the leading part of the locking device is maintained.

When upon closing of the second folding element the rearward part of the locking device comes into operative contact with the frame of the folding device, the guiding contour which is embodied in the second coupling element guides the leading part of the locking device out of the locked position. When pushing in the rearward part of the locking device toward the guiding contour, the guiding contour extends in such a way that the leading part is guided across it out of the locked position. Preferably, the guiding contour is designed as an incline (ramp) and the leading part of the locking device is embodied in a wedge shape. The locking device can be manufactured as a stamped or bent part in particular of spring steel. In a preferred embodiment, the locking element is substantially a flat stamped part of sheet metal which is angled at the rear and front.

In a further embodiment, the locking device is comprised of two parts, a locking member and a sliding element that moves the locking member. In this context, the leading part of the sliding element can engage a recess of the locking member.

A coupling device according to the invention that can be comprised of only three or four individual parts has particular advantages in regard to manufacture, assembly, and servicing. Moreover, the coupling device according to the invention can be retrofitted with minimal expenditure practically on any type of folding device. In addition, the opening mechanism of the locking device is substantially inaccessible so that a faulty operation can be substantially completely precluded.

Further advantages and details result from the claims and the illustrated embodiments which will be explained in the following.

BRIEF DESCRIPTION OF THE DRAWING

FIGS. 6*a* to 6*c* show another embodiment of the coupling device in an illustration according to FIGS. 4*a* to 4*c*.

FIGS. 7*a* to 7*c* shows the coupling device of FIGS. 6*a* to 6*c* in unlocked position.

DESCRIPTION OF THE PREFERRED EMBODIMENTS

Figure 1A:
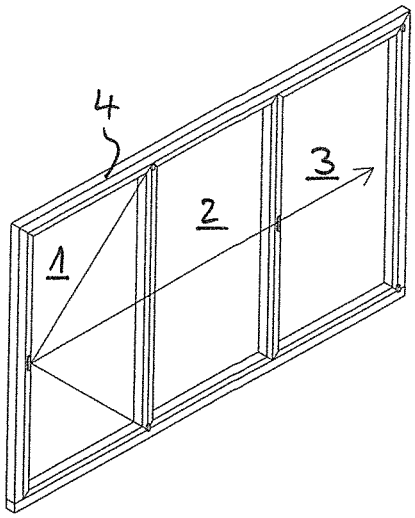
FIGS. 1*a* to 1*c* show schematically a folding device in closed position (FIG. 1*a*), partially open position (FIG. 1*b*), and open position (FIG. 1*c*).

Individual technical features of the embodiments described in the following can also be combined with the afore described embodiments as well as the features of the independent claims and further claims to subject matter in accordance with the invention.

Elements that functionally are acting at least partially in same way are identified with identical reference characters.

Figure 1B:
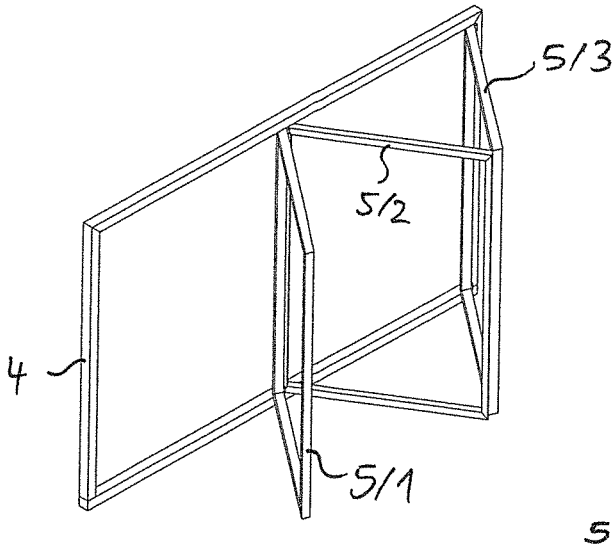
Figure 1C:
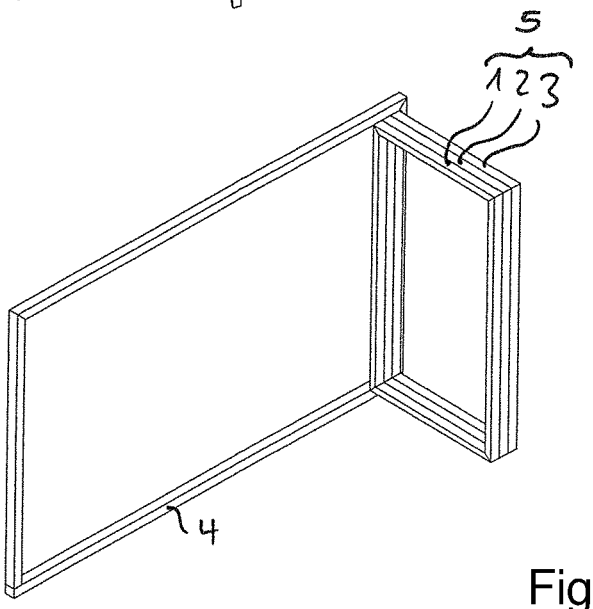

FIGS. 1*a* to 1*c* show a folding device with three folding elements 1, 2, 3 secured in a frame 4. The frame 4 however must not be embodied as a separate peripheral component but can also be embodied, for example, by surrounding wall or building areas, for example, when required guiding sections are embedded therein. The left folding element 1 in the illustration is designed as a rotary panel and the folding device opens, as symbolized in FIG. 1*a* by the arrows. FIG. 1*b* shows all three folding elements 1, 2, 3 of the device in partially open position in order to indicate their movement directions wherein it is precisely the position of the rotary panel 1 illustrated in FIG. 1*b* that is to be avoided by the coupling device in accordance with the invention. In FIG. 1*c*, the folding device is in completely open position in which the folding elements 1, 2, 3 with their boundary parts 5 are almost contacting each other. In the illustrated embodiment, the boundary parts 5 are panel frame sections of the folding elements 1, 2, 3 that carry glass elements (glass panes). However, in case of frameless panels, the boundary parts 5 can also be the edges of the glass elements.

Figure 2A:
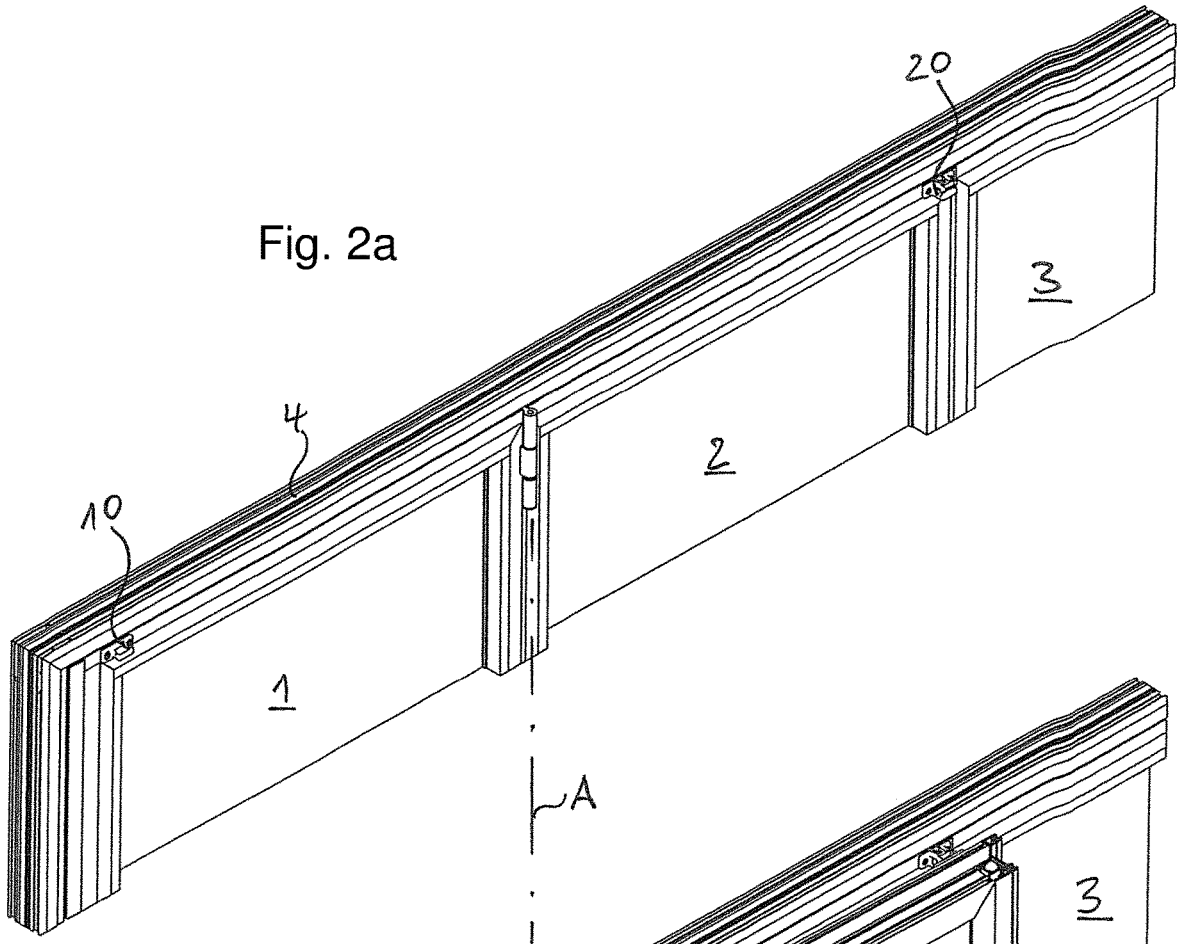
FIGS. 2*a* to 2*c* show enlarged details of FIGS. 1*a* to 1*c*, respectively.
Figure 2B:
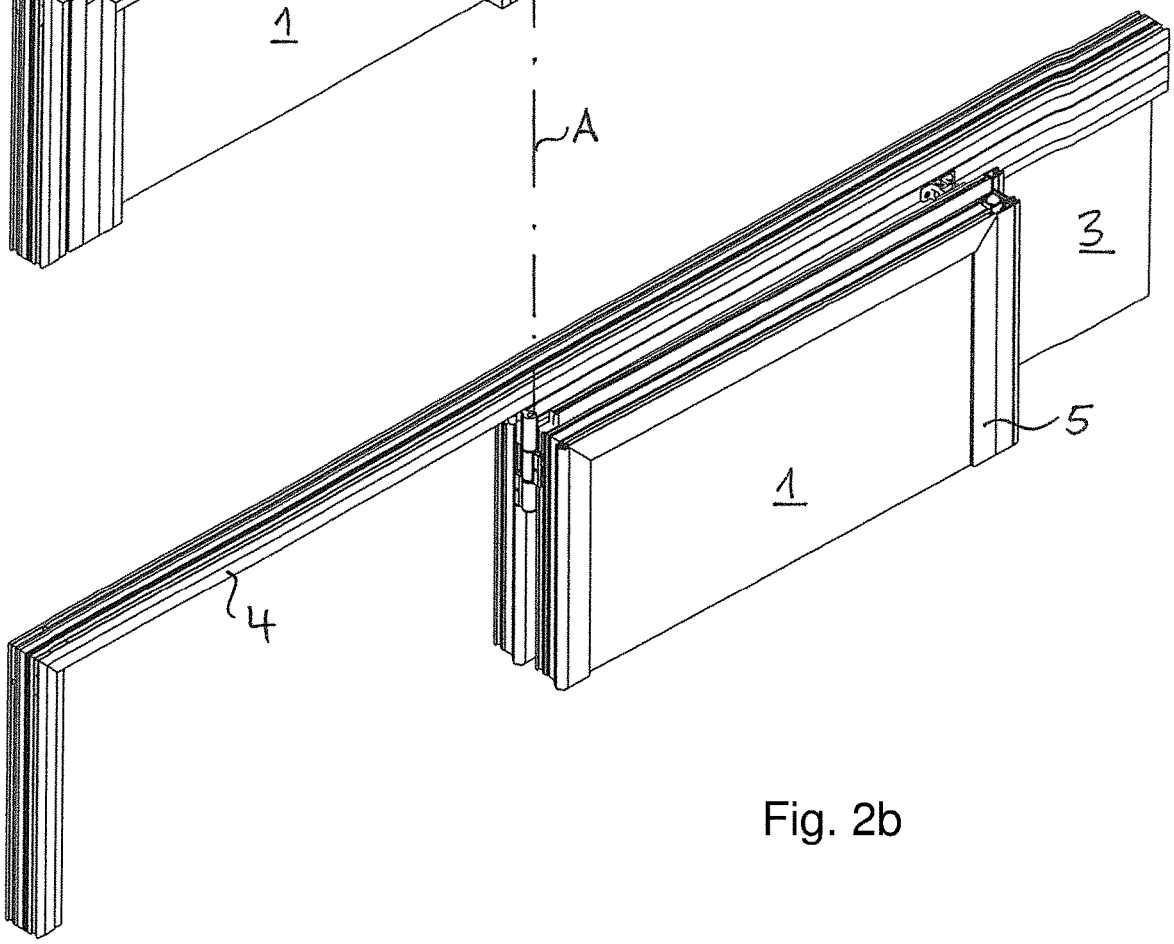
Figure 2C:
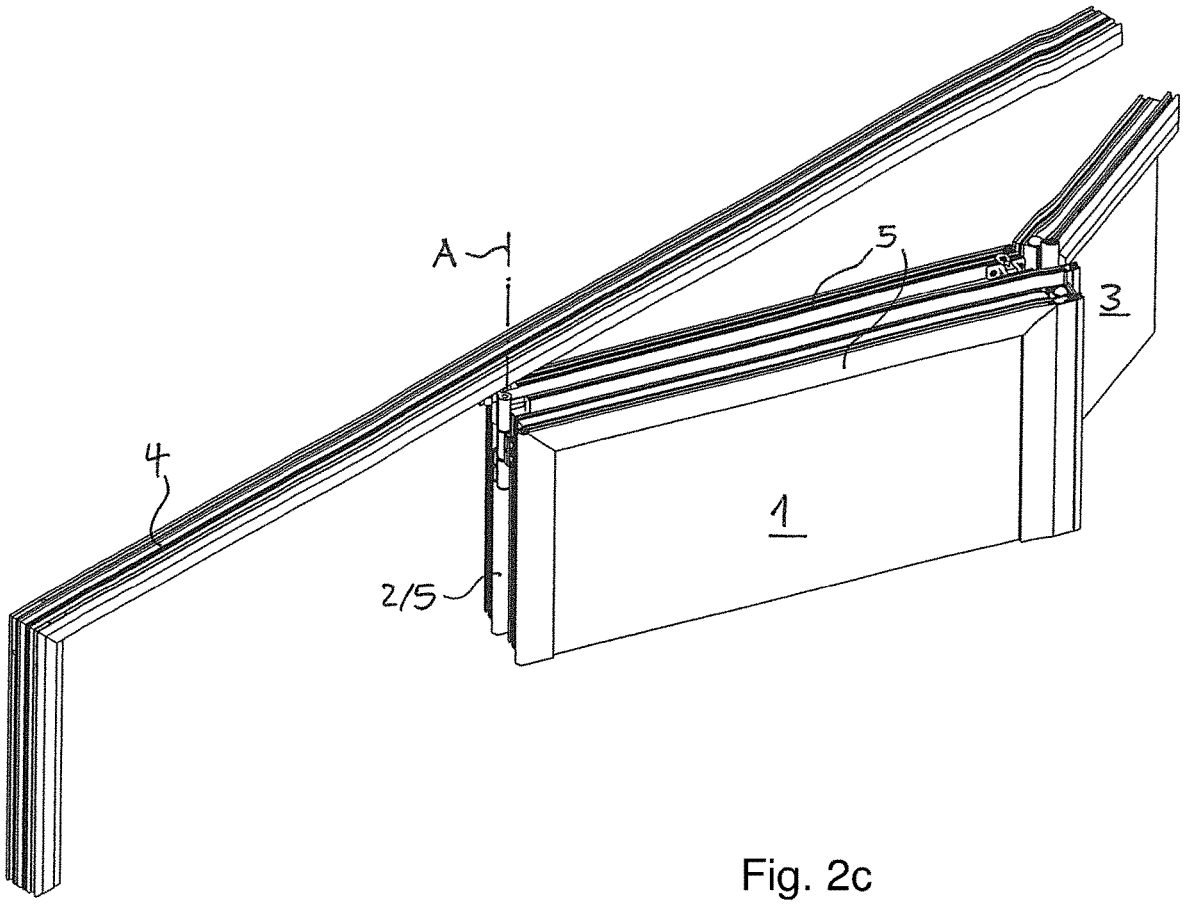

FIG. 2 shows in detail the upper left edge of the folding device with a first coupling element 10 arranged on the rotary panel 1 and a second coupling element 20 which is arranged on the directly neighboring folding element 2. For opening the folding device, first the rotary panel 1 is rotated about axis A and placed against the second folding element 2. In doing so, the coupling elements 10 and 20 latch with each other (see FIG. 2*b*) so that this position of the folding elements 1, 2 is maintained even when the folding device is opened farther, as indicated in FIG. 2*c*. The configuration and function of the coupling device according to the invention will be explained in the following with the aid of FIGS. 3, 4*a*-4*c*, 5*a*-5*c*, 6*a*-6*c*, 7*a*-7*c*, 8, and 9.

The coupling device is comprised substantially of the first coupling element 10, the second coupling element 20, and a locking device 30 which prevents separation of the coupling elements 10, 20 when the second folding element 2 is open. The first coupling element 10 in the embodiment is designed as a locking member and the second coupling element 20 is embodied as a corresponding locking receptacle which comprises a recess 21 surrounded by two springy locking tongues 22. The coupling elements 10, 20 form a latch device that is secured (locked) by the locking device 30 in the connected latched position (FIGS. 3 and 4*a*-4*c*) or, for disengagement of the coupling elements 10, 20 (FIGS. 5*a*-5*c*), can be released (unlocked). In the first embodiment (FIGS. 3, 4*a*-4*c*, 5*a*-5*c*), the locking device 30 comprises a sliding element 31 with a locking member 32. The locking member 32 engages in the locked position (FIGS. 3 and 4*a*-4*c*) a locking receptacle 11 formed in the first coupling element 10 so as to lock the coupling elements 10, 20. The rearward part of the sliding element 31 projects past a rearward edge 5' of the horizontal boundary part 5 of the folding element 2 to which the second coupling element 20 is connected; this rearward part is elastically supported against the rearward side 2' of the folding element 2 which is positioned opposite the coupling element 20 (see FIG. 4*b*). In the illustrated embodiment, this is realized in a preferred way in that the rearward part of the sliding element 31 itself is designed as a leaf spring 33. The sliding element 31 can be produced as a stamped bent part, preferably of sheet metal; such an embodiment is particularly preferred, simplifies production, and is inexpensive. As can be seen in FIGS. 3, 4*a*-4*c*, and 5*a*-5*c*, even a monolithic configuration of the sliding element 31 together with the locking member 32 at the front end that is bent in a hook shape is possible.

Figure 5B:
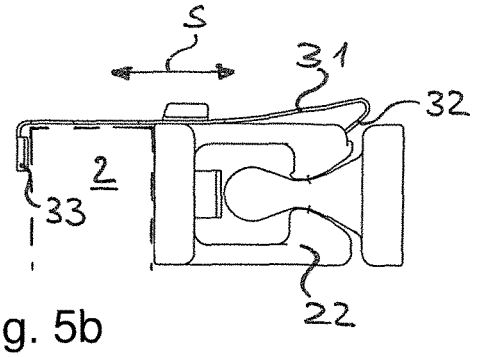
FIGS. 5*a* to 5*c* show views in accordance with FIGS. 4*a* to 4*c* of the coupling device in unlocked position.
Figure 4C:
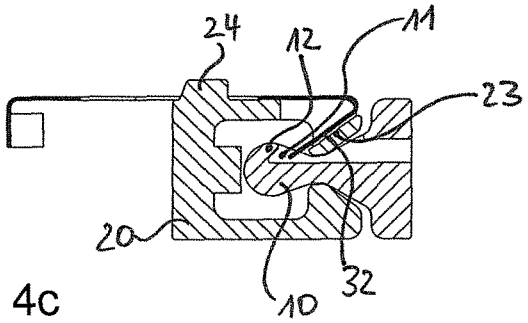
Figure 5C:
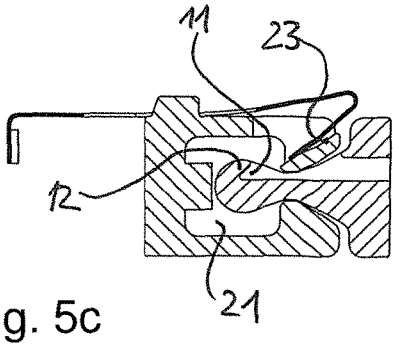
Figure 4A:
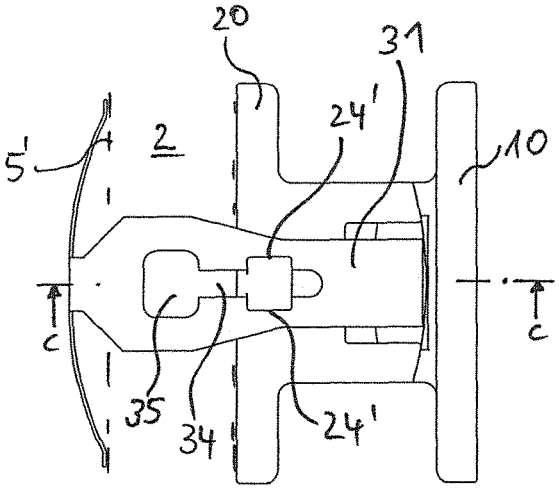
Figure 5A:
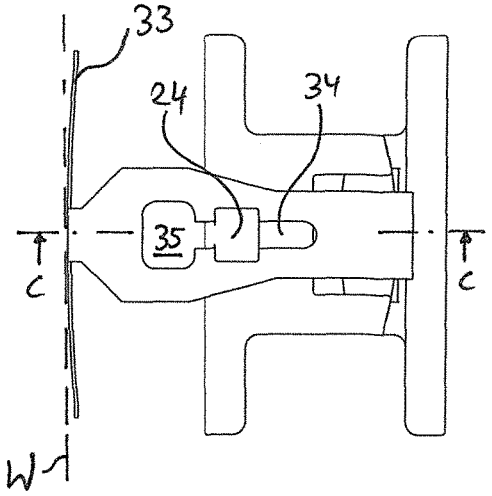

While the locking device 30 in FIGS. 3 and 4*a*-4*c* is illustrated in a locked rest position in which the leaf spring 33 is unstressed, FIGS. 5*a*-5*c* show a disengaged or unlocked position. Here, the second folding element 2 is closed so that the rearward part of the sliding element 31, here the leaf spring 33, is in operative contact with an abutment W which is formed by the frame 4 of the folding device. The leaf spring 33 is compressed so that the sliding element 31, in a movement direction S perpendicular to the plane E of the second folding element 2, is moved toward the first folding element 1. A guiding contour 23 is provided in the second coupling element 20, in the illustrated embodiment provided at its upper locking tongue 22, and pushes the locking member 32 out of the locking receptacle 11 so that the locking device 30 is disengaged (unlocked). In order to prevent that a simple pulling action acting on the rotary panel 1 or on the first coupling element 10 causes release of the locking device 30, the locking member 32 is designed as a hook in the illustrated embodiment and the locking receptacle (recess) 11 is provided with a projection 12 acting as a "barb".

The sliding element 31 is secured on the second coupling element 20 in a constructively simple but effective way in that the sliding element 31 comprises a slot-like cutout 34; an upwardly extending projection 24 of the second coupling element 20 passes through this cutout 34 and in this way guides the movements in the sliding direction S of the sliding element 31. In order to prevent that the sliding element 31 accidentally is released in upward direction from the coupling element 20, the projection 24 has preferably laterally widened portion 24' wider than the relevant parts of the slot-type cutout 34 so that the coupling device according to the invention can be installed not only at the top side of the folding elements but, if desired, also at the bottom side. For simplified assembly of the sliding element 31 on the coupling element 20 itself, in such an embodiment the slot-type cutout 34 of the sliding element 31 is provided with a mounting opening 35 which is greater than the widened portion 24' of the projection 24.

FIGS. 6*a*-6*c* and 7*a*-7*c* show a modified embodiment of the coupling device according to the invention in illustrations which correspond to those of FIGS. 4*a*-4*c* and 5*a*-5*c*. The modification concerns only the configuration of the locking member 32 which is a separate component in the embodiment of FIGS. 6*a*-6*c* and 7*a*-7*c*. The locking member 32 is of a wedge-shaped configuration and can glide with its slanted bottom side along a guiding contour 23 which forms a guiding ramp. For securing the locking member 32 on the sliding member 31, the leading part of the sliding element 31 is angled and is inserted into a receptacle 32' of the locking member 32. When this receptacle 32' as illustrated is provided with sufficient clearance, the leading part of the sliding element 31 is not subjected to a bending load even when being unlocked (FIGS. 7*a*-7*c*); and this can increase the service life of the locking device.

Figure 9:
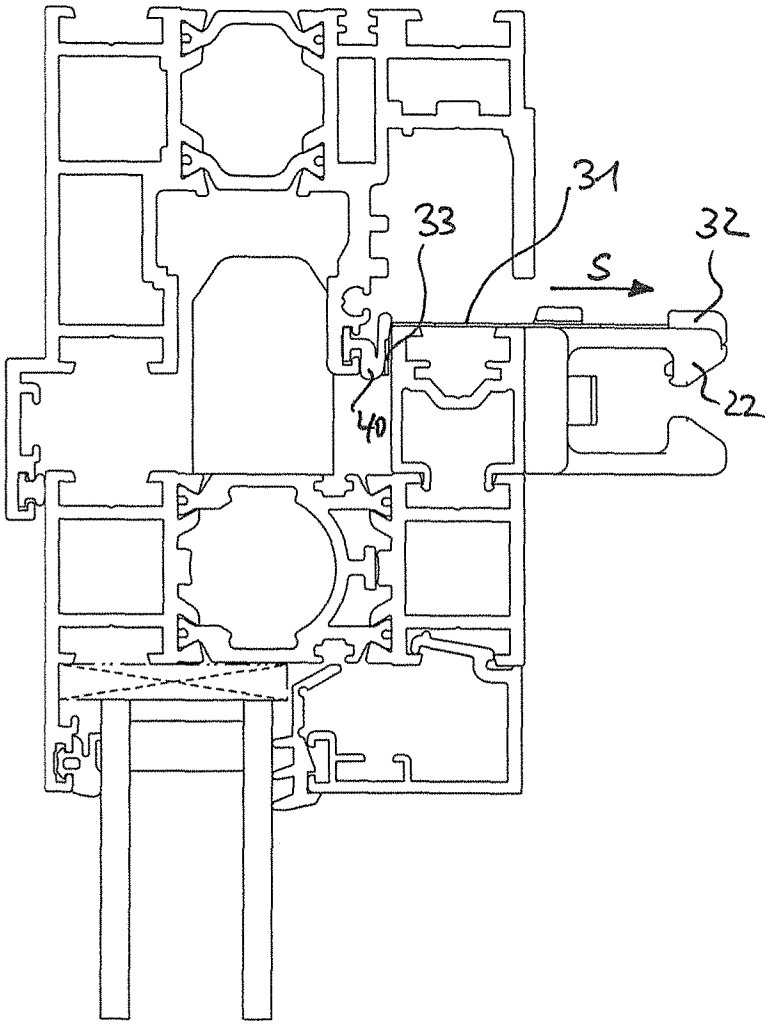
FIG. 9 illustrates the installation situation of the coupling device as shown in FIG. 7*b*.
Figure 8:
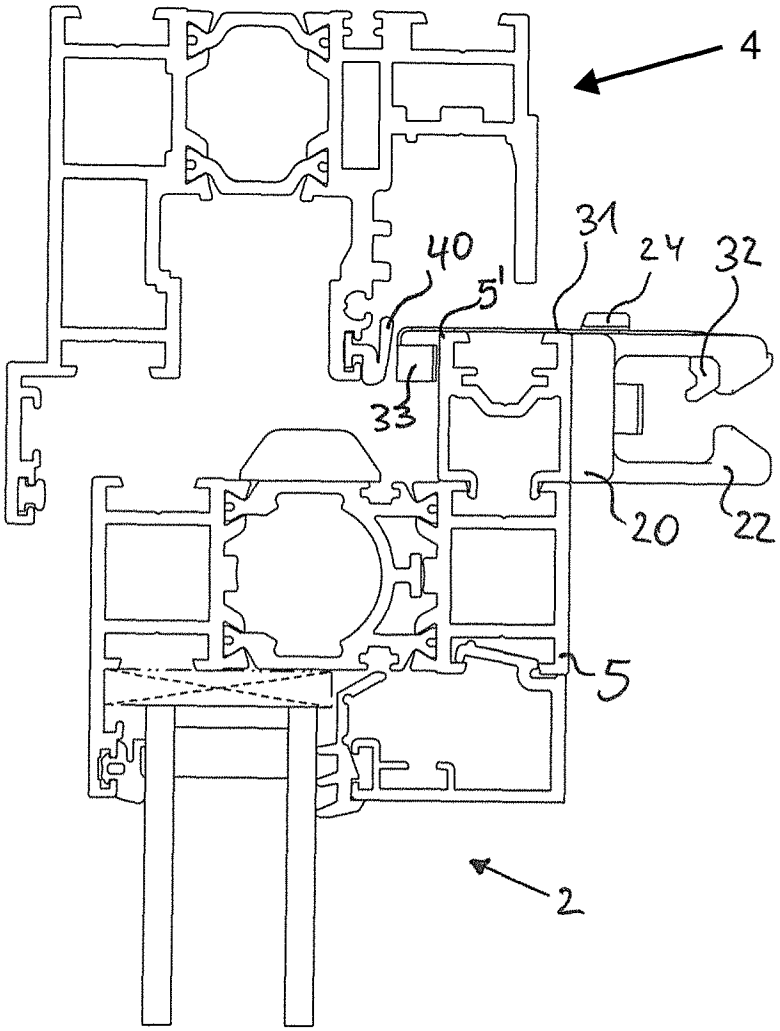
FIG. 8 illustrates the installation situation of the coupling device as shown in FIG. 6*b*.

FIGS. 8 and 9 show finally only the second coupling element 20 of the embodiment of FIGS. 6*a*-6*c* and 7*a*-7*c* in an installation situation. In FIG. 8, the folding element 2 which carries the coupling element 20 is not completely closed so that the leaf spring 33 of the sliding element 31 at the rear does not contact an abutment. In FIG. 9, on the other hand, the leaf spring 33 is compressed by the seal 40 of the frame 4 which forms the abutment so that the sliding element 31 is pushed in the direction S forwardly and moves the locking member 32 in forward/upward direction so as to disengage (unlock) the locking device 30.

Figure 3:
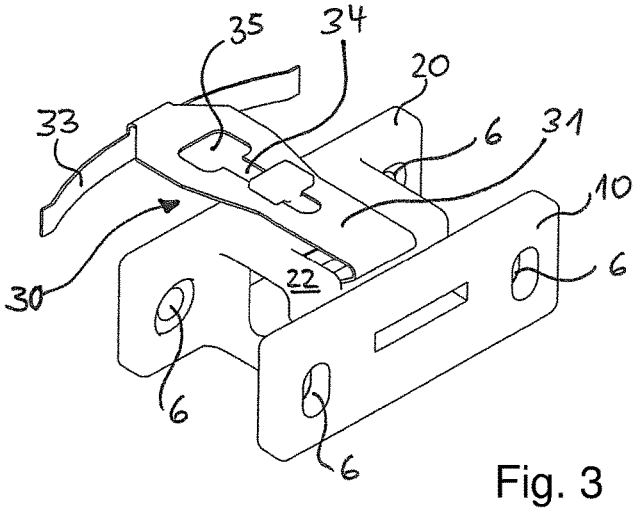
FIG. 3 shows the coupling device according to the invention in a perspective view.
Figure 4B:
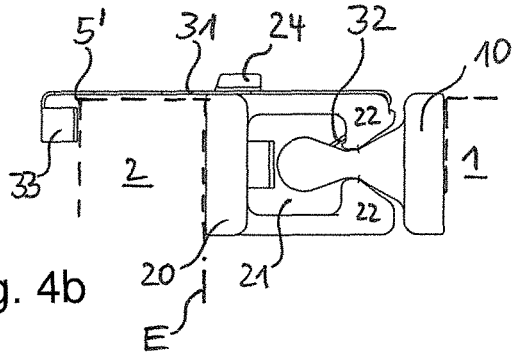
FIGS. 4*a* to 4*c* shows the coupling device of FIG. 3 in plan view (FIG. 4*a*) in side view (FIG. 4*b*), and section view (FIG. 4*c*).

The coupling device according to the invention can be embodied in a simple way and comprised of only three components (FIGS. 3, 4*a*-4*c*, 5*a*-5*c*) or four components (FIGS. 6*a*-6*c*, 7*a*-7*c*) but is effective despite the simple configuration Individual components in a service situation can be exchanged in a simple way; also, the entire device can be retrofitted. It can be screwed onto folding elements 1, 2 (see receptacles 6 in FIG. 3 provided for fastening elements) but can also be embodied to be adhesively connected or to be inserted into profiled sections of the boundary parts 5 of folding elements.

The specification incorporates by reference the entire disclosure of German priority document 10 2017 100 742.3 having a filing date of Jan. 16, 2017.

While specific embodiments of the invention have been shown and described in detail to illustrate the inventive principles, it will be understood that the invention may be embodied otherwise without departing from such principles.

What is claimed is:

1. A lockable coupling device for a folding device comprising at least three substantially planar folding elements arranged in a frame, wherein the at least three substantially planar folding elements include a first folding element and a second folding element neighboring the first folding element, wherein the first folding element is pivotably connected to the second folding element about a substantially vertical axis; the lockable coupling device comprising:

a first coupling element and a second coupling element configured to releasably lock with each other, wherein the first coupling element is configured to be arranged at the first folding element and the second coupling element is configured to be arranged at the second folding element in a mounted position, wherein the first and second coupling elements are configured to engage each other and latch in a latched position;

a locking device comprising a sliding element slidably arranged on the second coupling element in a direction substantially perpendicular to a plane of the second folding element, when the second coupling element is arranged in the mounted position, wherein the sliding element has a length extension, wherein the sliding element comprises a leading part and a rearward part, wherein the leading part and the rearward part are arranged opposite each other, viewed in said length extension;

wherein the leading part of the sliding element comprises a locking member and projects past a leading edge of a horizontal boundary part of the second folding element, when the second coupling element is arranged in the mounted position, wherein the leading edge is facing the second coupling element;

wherein the rearward part of the sliding element projects past a rearward edge of the horizontal boundary part of the second folding element, when the second coupling element is arranged in the mounted position, wherein the rearward edge is facing away from the second coupling element;

wherein the rearward part of the sliding element comprises a spring, wherein the rearward part of the sliding element is supported by the spring on a side of the second folding element that is opposite the second coupling element, when the second coupling element is arranged in the mounted position;

wherein the rearward part is configured such that, when the second coupling element is in the mounted position and the second folding element is not in a closed position, the rearward part is arranged in a rest position projecting past the rearward edge, wherein in the rest position the locking member of the leading part of the sliding element engages by a locking action a locking receptacle of the first coupling element when the first and second coupling elements are in the latched position, wherein in the rest position the locking member contacts a guiding contour of the second coupling element such that unlocking of the locking member from the locking receptacle of the first coupling element by a pulling movement acting between the first and the second coupling elements is prevented;

wherein the rearward part is configured such that, when the second coupling element is in the mounted position and the second folding element is moved into a closed position in the frame, the rearward part of the sliding element is configured to abut against the frame, and push the sliding element in a direction of said length extension so that the locking member of the leading part is pushed along the guiding contour out of the locking receptacle of the first coupling element and the locking action is released.

2. The coupling device according to claim 1, wherein the sliding element is a bent part.

3. The coupling device according to claim 1, wherein the sliding element is a bent sheet metal part.

4. The coupling device according to claim 1, wherein the sliding element and the locking member form a monolithic piece.

5. The coupling device according to claim 1, wherein the spring is a leaf spring.

6. The coupling device according to claim 1, wherein the locking member comprises a slanted bottom side and wherein the guiding contour comprises a guiding ramp interacting with the slanted bottom side of the locking member.

7. The coupling device according to claim 1, wherein the first coupling element is a male latching part and the second coupling element is a female latching receptacle, wherein the male latching part comprises the locking receptacle for the locking member and the locking receptacle is a recess.

8. The coupling device according to claim 1, wherein the second coupling element comprises a projection extending substantially in a vertical direction, wherein the sliding element engages the projection.

9. The coupling device according to claim 8, wherein the sliding element comprises a slot and the projection engages the slot such that a movement of the sliding element in a direction of the length extension is enabled.

10. The coupling device according to claim 9, wherein the slot comprises a mounting opening that is wider than a widened portion of the projection.

11. The coupling device according to claim 1, wherein the sliding element comprises a substantially planar center part and the rearward part is a bent part that is bent relative to the center part of the sliding element.

12. The coupling device according to claim 1, wherein the sliding element comprises a substantially planar center part and the leading part is a bent part that is bent relative to the center part of the sliding element.

13. The coupling device according to claim 1, wherein the sliding element comprises a substantially planar center part, wherein the leading part and the rearward part are bent parts that are bent relative to the center part of the sliding element.

14. A folding device comprising at least three folding elements arranged in a frame, wherein the at least three folding elements include a first folding element and a second folding element, wherein the first folding element is arranged at the second folding element so as to be pivotable about a substantially vertical axis in such a way that the first folding element can be placed against the second folding element, wherein the folding device comprises the coupling device according to claim 1.

* * * * *